US010384337B2

(12) United States Patent
Ashmead

(10) Patent No.: US 10,384,337 B2
(45) Date of Patent: Aug. 20, 2019

(54) UNIVERSAL HANDLE ATTACHMENT FOR C-CLAMPS

(71) Applicant: The Boeing Company, Chicago, IL (US)

(72) Inventor: Andrew Ray Ashmead, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 12 days.

(21) Appl. No.: 15/598,086

(22) Filed: May 17, 2017

(65) Prior Publication Data

US 2018/0333827 A1 Nov. 22, 2018

(51) Int. Cl.

| | |
|---|---|
| ***B25B 5/10*** | (2006.01) |
| ***B25G 3/10*** | (2006.01) |
| ***B25G 3/32*** | (2006.01) |
| ***B25B 13/50*** | (2006.01) |

(52) U.S. Cl.

CPC ..... *B25G 3/10* (2013.01); *B25B 5/101* (2013.01); *B25B 13/5091* (2013.01); *B25G 3/32* (2013.01)

(58) Field of Classification Search

CPC .... B25B 5/16; B25B 5/10; B25B 5/18; B25B 5/067; B25B 5/068; B25B 5/101; B25B 5/102; B25B 5/125; B25B 13/50; B25B 13/5091; B25B 23/16; B25G 1/00; B25G 1/01; B25G 1/002; B25G 1/005; B25G 1/007; B25G 1/10; B25G 1/102; B25G 3/00; B25G 3/02; B25G 3/04; B25G 3/06; B25G 3/08; B25G 3/10; B25G 3/32; B63H 20/02; F16K 31/60; F16K 31/602; F16K 31/605; Y10T 82/00; Y10T 82/29

USPC ..... 269/143, 239, 249, 285, 329; 74/192, 74/473.1, 478, 479, 528, 529, 543; 251/291; 16/110.1, 431, 422, 426, 430, 16/432; 81/177.1, 489

See application file for complete search history.

(56) References Cited

U.S. PATENT DOCUMENTS 4,074,899 A * 2/1978 Hochstetler ..... B23P 11/00 269/249
4,283,152 A * 8/1981 Smith ..... F16B 7/0486 256/65.01
4,699,020 A * 10/1987 Bush ..... B25B 27/0028 74/544

(Continued)

FOREIGN PATENT DOCUMENTS

DE 3903894 A1 * 10/1989 ..... B25B 1/24

OTHER PUBLICATIONS

DE-3903894-A1 translation, Espacenet website (Year: 2018).*

*Primary Examiner* — Joseph J Hail
*Assistant Examiner* — Timothy Brian Brady
(74) *Attorney, Agent, or Firm* — Duft & Bornsen, PC

(57) ABSTRACT

A universal handle attachment for C-clamps. The handle attachment includes a rigid body having a first side to engage a C-clamp, and a second side opposite to engage a rotation tool. In the first side, a first channel and a second channel which are perpendicular with one another each are configured to receive a T-bar of the C-clamp. A center space in the first side at the intersection of the first channel and the second channel is configured to receive a top end of the screw. Each channel includes clip spaces on both sides of the center, and clips situated in the clip spaces. The clips each have an opening to secure the T-bar within the channels.

20 Claims, 15 Drawing Sheets

(56) References Cited

U.S. PATENT DOCUMENTS

| | | | | |
|---|---|---|---|---|
| 5,758,870 | A * | 6/1998 | Weaver | B25B 5/101 269/239 |
| 7,278,668 | B1 * | 10/2007 | Simmons | A46B 17/02 16/422 |
| 8,499,667 | B2 * | 8/2013 | Johnson | B25B 15/008 81/177.2 |
| 2001/0022118 | A1 * | 9/2001 | Zollmann | B23B 31/201 81/176.15 |
| 2008/0115631 | A1 * | 5/2008 | Liu | B25B 13/463 81/60 |
| 2015/0298313 | A1 * | 10/2015 | Geiger | E05B 1/0069 16/110.1 |

* cited by examiner

UNIVERSAL HANDLE ATTACHMENT FOR C-CLAMPS

FIELD

This disclosure relates to clamp devices, and more particularly, to a handle for C-clamps.

BACKGROUND

C-clamps are rugged metal clamps that tighten with a screw mechanism. The screw is driven by a cross-bar (often referred to as a T-bar) which intersects with the screw and is rotated by hand. When it is desirable for the C-clamp to provide a large amount of pressure to a workpiece, a worker tightly grips the T-bar and applies a significant amount of rotational force. Workers that frequently perform tasks with C-clamps often experience hand fatigue from gripping the metal T-bars. Since there are a variety of different T-bar sizes and styles, current gripping solutions are either limited to a specific T-bar size, limited in ability to ergonomically apply large amounts of force, or both.

SUMMARY

Embodiments described herein provide a universal handle attachment for C-clamps. The handle is rigid yet easily attaches to different sizes of T-bars of C-clamps. The handle has multiple intersecting channels to enable a user to grasp a T-bar with the handle in multiple rotational orientations. Each channel has notches that hold removable, flexible clips. Since the clips are interchangeable, the channels can be adapted to a variety of different types and sizes for the T-bar. At the center of the handle where the channels intersect, a spring loaded member may be provided which applies a centering force around the T-bar and screw collar of the C-clamp. The increased rotational grip on the T-bar and screw collar of the C-clamp enables the handle to apply increased amounts of rotational force to a range of T-bar types without slippage. As such, the handle may also incorporate through holes that enable increased amounts of rotational force provided by hand or tools.

One embodiment is an apparatus that includes a handle attachment. The handle attachment is configured to attach to a C-clamp with a screw and a T-bar perpendicular to the screw. The handle attachment includes a rigid body having a first side configured to engage the C-clamp, and a second side opposite to the first side configured to engage a rotation tool. The handle attachment also includes a first channel extending across the first side that is configured to receive the T-bar, a second channel extending across the first side perpendicularly with the first channel that is configured to receive the T-bar, and a center space in the first side at the intersection of the first channel and the second channel that is configured to receive a top end of the screw. The handle attachment further includes first clip spaces in the first channel on both sides of the center, second clip spaces in the second channel on both sides of the center, first clips situated in the first clip spaces, and second clips situated in the second clip spaces. The first clips and the second clips each include an opening to secure the T-bar within the first channel and the second channel, respectively.

Another embodiment is an apparatus that includes a handle attachment. The handle attachment is configured to attach to a clamp with a screw and a bar attached through a screw collar near a top end of the screw. The handle attachment includes a body having a first side configured to engage the screw collar and the bar of the clamp, and a second side opposite to the first side. The handle attachment also includes a plurality of channels formed in the first side sized to receive the bar of the clamp. The channels cross one another to form an intersection at a center of the first side. The handle attachment further includes a plurality of walls spaced around the intersection of the channels to define a center space sized to receive the screw collar of the clamp. Each wall is located at a corner of the intersection and faces the center. The handle attachment also includes flexible members extending from the walls toward the center. The flexible members are configured to retract away from the center toward the walls from contact with the screw collar of the clamp.

Yet another embodiment is an apparatus that includes a handle attachment. The handle attachment is configured to attach to a clamp with a screw and a bar attached through the screw at the screw collar. The handle attachment includes a body with a cross-shaped perimeter to form a plurality of handle members, a first side with a first top surface, and a second side opposite to the first side with a second top surface. The perimeter defines a thickness of the body and connects the first top surface with the second top surface. The first top surface and the second top surface are substantially flat and parallel with one another. The handle attachment also includes channels formed along the first side to receive the bar. The channels are centered inside the cross-shaped perimeter and having a depth into the first top surface that is smaller than the thickness of the cross-shaped perimeter. The channels also intersect one another near a center of the first side and extend through ends of the handle members to form openings in the cross-shaped perimeter. The handle attachment further includes a circular space at the center of the first side to receive the screw collar. The circular center also has the same depth into the first side. The handle attachment also includes clip spaces crossing longitudinal axes of the channels. The clip spaces are sized to receive removable clips and also have the depth into the first side. The removable clips have passages that align with the longitudinal axes of the channels. The passages are sized smaller than the channels to secure the bar. The handle attachment also includes curved inner walls surrounding the circular space, chambers in the curved inner walls that face the center; and spring loaded members situated within the chambers. Each spring loaded member includes a compressible head which protrudes from a curved inner wall into the center space. The compressible head is configured to retract from the center space and into the curved inner wall from contact with the screw collar.

The above summary provides a basic understanding of some aspects of the specification. This summary is not an extensive overview of the specification. It is intended to neither identify key or critical elements of the specification nor delineate any scope of the particular embodiments of the specification, or any scope of the claims. Its sole purpose is to present some concepts of the specification in a simplified form as a prelude to the more detailed description that is presented later.

DESCRIPTION OF THE DRAWINGS

Some embodiments are now described, by way of example only, and with reference to the accompanying drawings. The same reference number represents the same element or the same type of element on all drawings.

DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
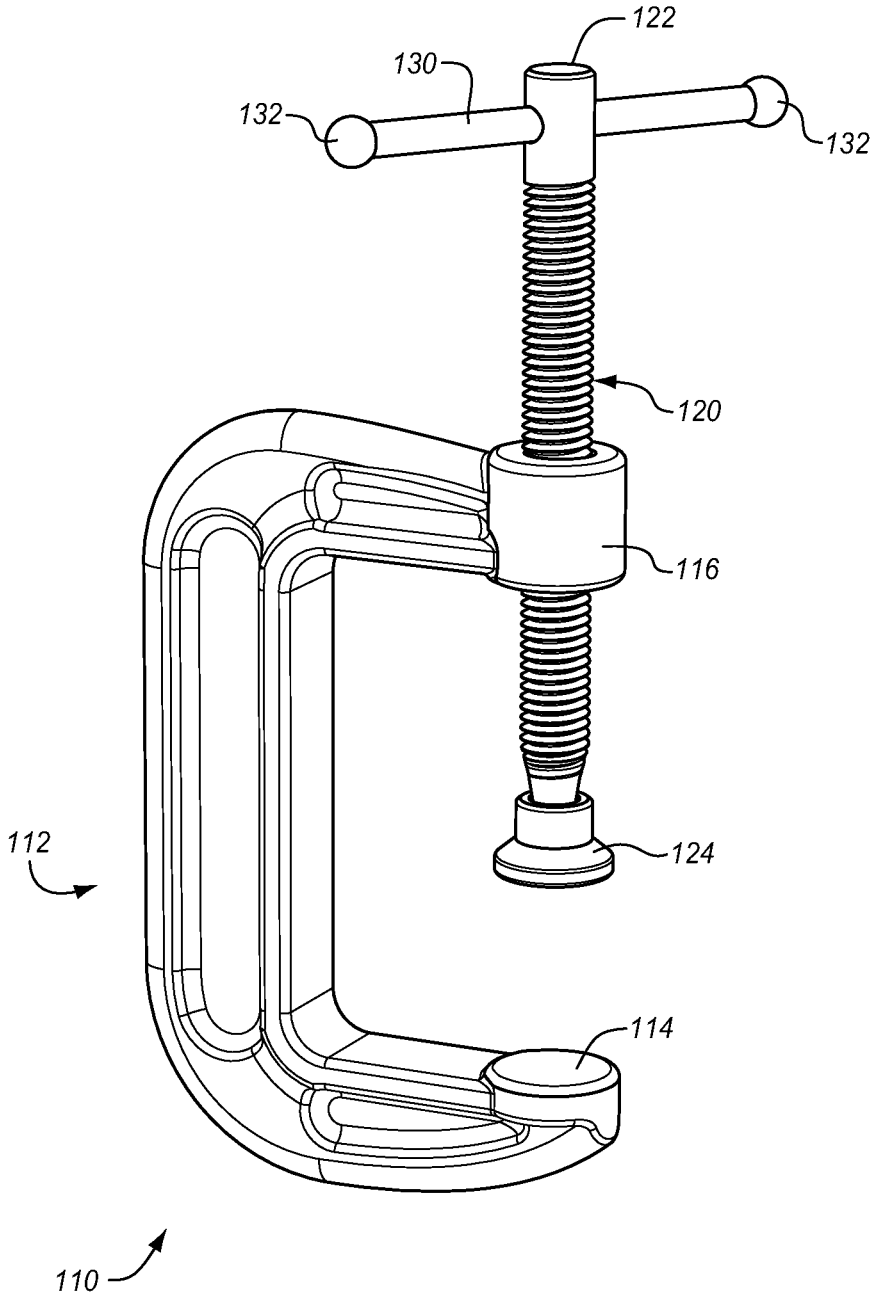
FIG. 1 PRIOR ART
FIG. 1 illustrates a C-clamp of the prior art.

FIG. 1 illustrates a C-clamp 110 of the prior art. The C-clamp 110 is typically made of a metal such as steel, iron, or aluminum and is used to apply pressure to one or more objects. The C-clamp 110 includes a C-shaped frame 112 with a fixed jaw 114 and a threaded hole 116 which supports a screw 120. The screw 120 is a threaded rod with a collar 122 at one end and a shoe 124 at the other end. The screw 120 is driven by a T-bar 130 (sometimes referred to as a crossbar or a Tommy bar) that intersects perpendicularly through the screw 120 at or near the collar 122 to form a handle. Rotation of the T-bar 130 causes the screw 120 to move toward or away from the fixed jaw 114. Generally, an object or objects are contained between the shoe 124 and the fixed jaw 114, and the T-bar 130 is turned by hand to move the screw 120 through the threaded hole 116 until a desired state of pressure is reached.

The C-clamp 110 is made in a variety of different styles and sizes and it is common for the T-bar 130 to also vary in style and size. For instance, the T-bar 130 may slide or translate through a hole in the screw 120 to support increased leverage or rotation in a crowded workspace. Alternatively, a center of the T-bar 130 may be fixed with the screw 120. The T-bar 130 may also include rounded ends 132 (or another shape at its ends) to prevent the T-bar 130 from inadvertently falling out of the screw 120 and/or to accommodate hand grip for rotating the T-bar 130. Moreover, the overall dimensions of the T-bar 130 (e.g., length, diameter, etc.) may be different for various clamps. As such, current solutions for gripping the T-bar 130 are either limited to a specific T-bar size, limited in ability to ergonomically apply large amounts of force, or both.

Figure 2A:
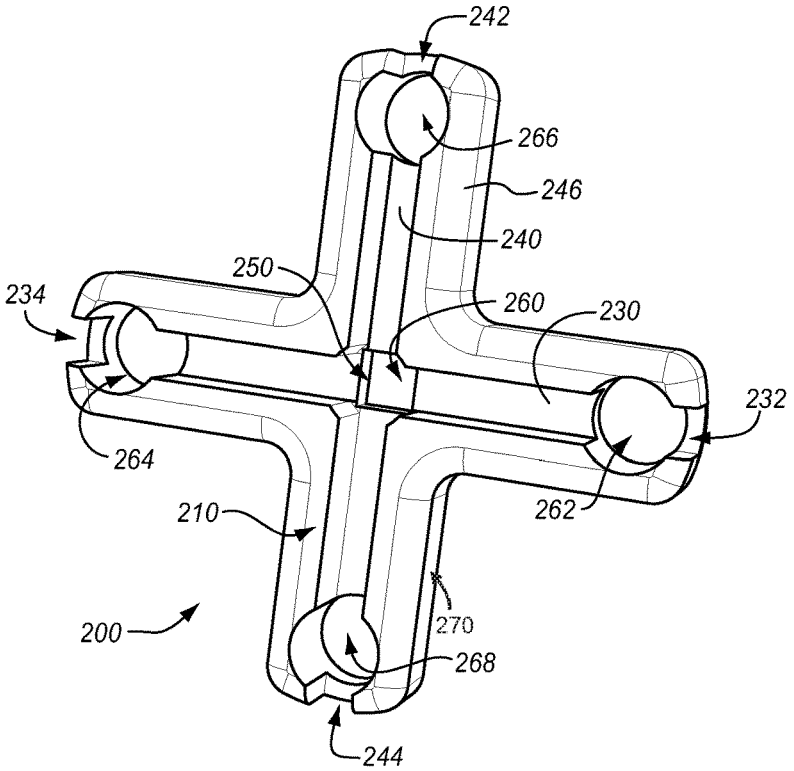
FIG. 2A is a perspective view of a handle attachment in an exemplary embodiment.

FIG. 2A is a perspective view of a handle attachment 200 in an exemplary embodiment. The handle attachment 200 enables improved attachment to a wide variety of clamp handles, such as various sizes of the T-bar 130 of the C-clamp 110, as well as an improved ability to apply large clamping forces. Although the handle attachment 200 is often described herein with respect to the C-clamp 110 and the T-bar 130 of FIG. 1, it will be appreciated that such description is exemplary for purposes of discussion and that embodiments herein may apply to C-clamps (which are sometimes referred to as G-clamps) with alternative styles or components, apply to other types of clamps (e.g., bar clamps, sash clamps, pipe clamps, mitre clamps, etc.), and/or apply to alternative clamp handle styles (e.g., wing-nut), shapes, and dimensions.

FIG. 2A shows a first side 210 of the body 246 of the handle attachment 200. The first side 210 has a grooved surface configured to engage with the T-bar 130 of the C-clamp 110. The grooves are formed by a first channel 230 and a second channel 240 which are coplanar and intersect perpendicularly with one another at or near a relative center of the body of the handle attachment 200. As such, the intersection of the first channel 230 and the second channel 240 forms a center 250 which is also indented or hollow along the plane of the first channel 230 and the second channel 240. The channels 230/240 may extend all the way across the first side 210. Thus, the channels 230/240 may be unrestrained at a perimeter 270 of the handle attachment 200 with the first channel 230 having open ends 232-234 and the second channel 240 having open ends 242-244.

Figure 2B:
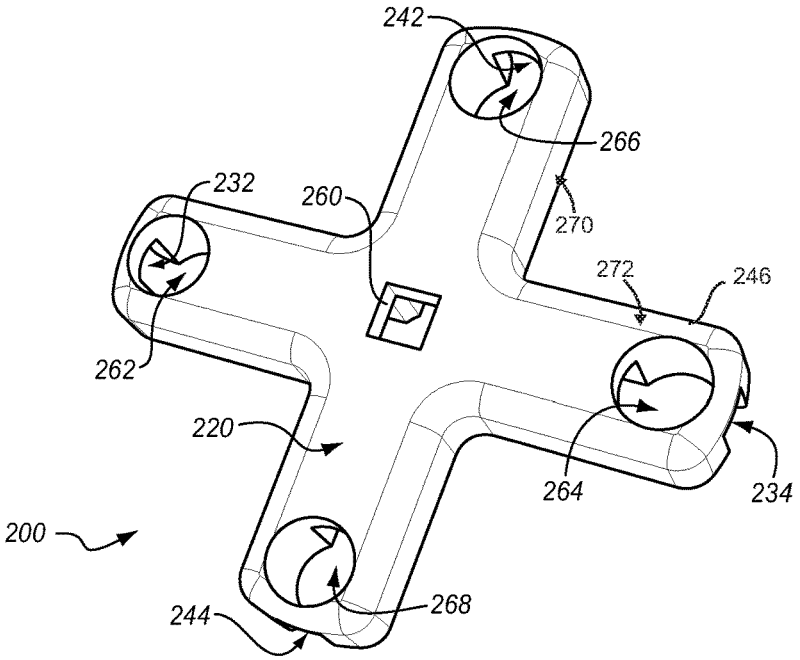
FIG. 2B is another perspective view of a handle attachment in an exemplary embodiment.

FIG. 2B is another perspective view of the handle attachment 200 in an exemplary embodiment. FIG. 2B shows a second side 220 of the body 246 of the handle attachment 200 shown in FIG. 2A. The second side 220 is configured to engage with a human hand and/or tool and as such may include a drive 260 and/or one or more grip holes 262-268. The drive 260 is a square shaped hole or indentation (or alternative non-circular shape) in the second side 220 configured to engage with a tool such as a socket wrench or drill bit of a power tool. The grip holes 262-268 are holes or indentations (e.g., circular, oval, or an alternative shape) in the second side 220 configured to engage with a human finger or an object such as a cylindrical rod.

The drive 260 is located at or near a center rotational axis of the handle attachment 200 to accommodate hand and power tools that rotate objects. The grip holes 262-268 are located a distance away from the center rotational axis of the handle attachment 200 to leverage rotational forces applied to the handle attachment 200. The grip holes 262-268 may be located proximate to a perimeter 270 or side of the body 246 of the handle attachment 200 to maximize leverage without interfering with the structural integrity of the handle attachment 200. For example, the grip holes 262-268 may slightly overlap, border, or be proximate with a transition surface 272 which angles or curves between the top surface of the second side 220 and the perimeter 270 for ergonomically gripping the handle attachment 200. Alternatively or additionally, the grip holes 262-268 may border or be proximate with the open ends 232-234/242-244 or the perimeter 270.

The drive 260 and/or the grip holes 262-268 may be through holes which extend into the second side 220 and through the first side 210. By contrast, the channels 230/240 extend into the first side 210 but not through to the second side 220. That is, the channels 230/240 have a depth into the top surface of the first side 210 that is shorter than the thickness of the perimeter 270 or side of the handle attachment 200 that is between the top surface of the first side 210 and the top surface of the second side 220. The top surfaces of the first side 210 and the second side 220 may each be formed of a flat or substantially flat surface as shown in FIG. 2A and FIG. 2B. The floor bed and/or the inner walls of the channels 230/240 may also be flat or substantially flat as shown in FIG. 2A. A horizontal plane along or parallel with the floor bed of the channels 230/240 may define a border between the first side 210 and the second side 220.

Figure 3A:
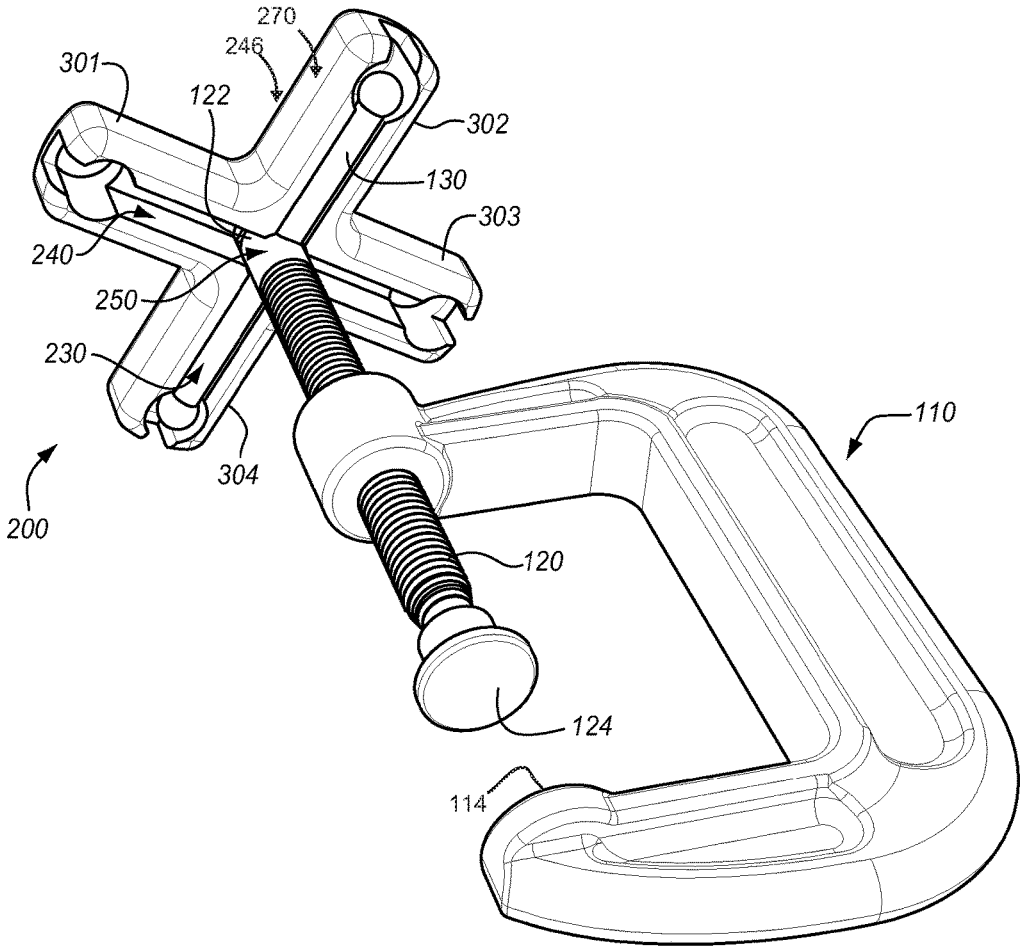
FIG. 3A is a perspective view of a handle attachment engaged with a C-clamp in an exemplary embodiment.

FIG. 3A is a perspective view of a handle attachment 200 engaged with a C-clamp 110 in an exemplary embodiment. When engaged, the center 250 overlaps with the collar 122 of the screw 120 and one of the channels 230/240 overlaps with the T-bar 130. The center 250 and the channels 230/240 may be sized slightly larger than the collar 122 and the T-bar 130, respectively, such that the handle attachment 200 may be fit or slid on top of the collar 122 and the T-bar 130. In this example, the T-bar 130 is shown occupying the space of the first channel 230. However, since the first channel 230 and the second channel 240 may be equally or similarly sized (e.g., in length, width, and/or depth), the handle attachment 200 may engage with the C-clamp 110 in multiple different rotational positions.

With one of the channels 230/240 engaged with the T-bar 130, the handle attachment 200 may be rotated by hand or with a tool. The rotational force of the handle attachment 200 transfers to the T-bar 130 and the screw 120 and translates into a pressure force applied via the shoe 124 at the other end of the screw 120. In addition to providing increased surface area and/or a non-metal material to improve hand grip, the handle attachment 200 incorporating the drive 260 and/or one or more of the grip holes 262-268 advantageously provides one or multiple options for applying increased rotational forces (and thus increased clamping force of the C-clamp 110) as compared to hand rotation of the T-bar 130 alone. The screw drive 260 and the grip holes 262-268 may also enable viewing the collar 122 and the T-bar 130, respectively, from an opposite side of the handle attachment 200 to facilitate alignment and engagement with the C-clamp 110. Still further, the grip holes 262-268 may also effectively widen an end portion of the channels 230/240 (e.g., proximate to the open ends 232-234/242-244) to accommodate the rounded ends 132 for particular versions of the T-bar 130. The open ends 232-234/242-244 advantageously enable the handle attachment 200 to engage multiple different lengths of the T-bar 130 including versions of the T-bar 130 which are longer than the channels 230/240 and length of the handle attachment 200.

As shown in FIG. 3A, the body 246 of the handle attachment 200 may be a unitary structure with a plurality of handle members 301-304. Each handle member 301-304 extends from the rotational center of the handle attachment 200 to provide a distinct grip member. In some embodiments (e.g., such as that shown in FIGS. 2A, 2B, and 3A), the perimeter 270 of the handle members 301-304 defines a structural body 246 that outlines the channels 230/240. That is, the handle members 301-304 may form a cross-shaped structural body 246 for the handle attachment 200 with uniform walls symmetrical about the channels 230/240. The handle attachment 200 may have multiple orders of rotational symmetry with respect to the first side 210 and the second side 220 to facilitate engagement with the T-bar 130 in multiple different rotational positions. For instance, when viewing the first side 210 and the second side 220 of the handle attachment 200 in the embodiments shown in FIGS. 2A, 2B, and 3A, the body shape of the handle attachment 200 may be rotated in ninety degree increments and look the same for a rotational symmetry on the fourth order. However, alternative shapes, configurations, and numbers of the channels 230/240 and the handle members 301-304 are possible.

The body 246 of the handle attachment 200 may be formed by molding (e.g., via injection molding, investment casting, 3-D printing, etc.) a suitable plastic material into a single piece of continuous material. The overall shape and dimension of the material may define each of the components and features of the handle attachment 200 described herein, including the handle members 301-304, the perimeter 270, the channels 230/240, the center 250, the open ends 232-234/242-244, the drive 260, and the grip holes 262-268. The body 246 of the handle attachment 200 may be formed with a rigid material structure which has little or no deformation from forces applied to the handle attachment 200 to rotate the T-bar 130. Alternatively or additionally, the body 246 of the handle attachment 200 may be formed with a material structure that at least partially collapses the channels 230/240 and/or the open ends 232-234/242-244 inward under rotational force applied to the handle attachment 200 to increase frictional restraint of the T-bar 130. Alternatively or additionally, the channels 230/240 may be lined with or include a material (e.g., rubber, foam, etc.) that is different than the structural body 246 material for increased frictional restraint of the T-bar 130. Alternatively or additionally, the inner walls and/or floor bed of the channels 230/240 may be curved or angled to accommodate increased frictional restraint of the T-bar 130.

Figure 3B:
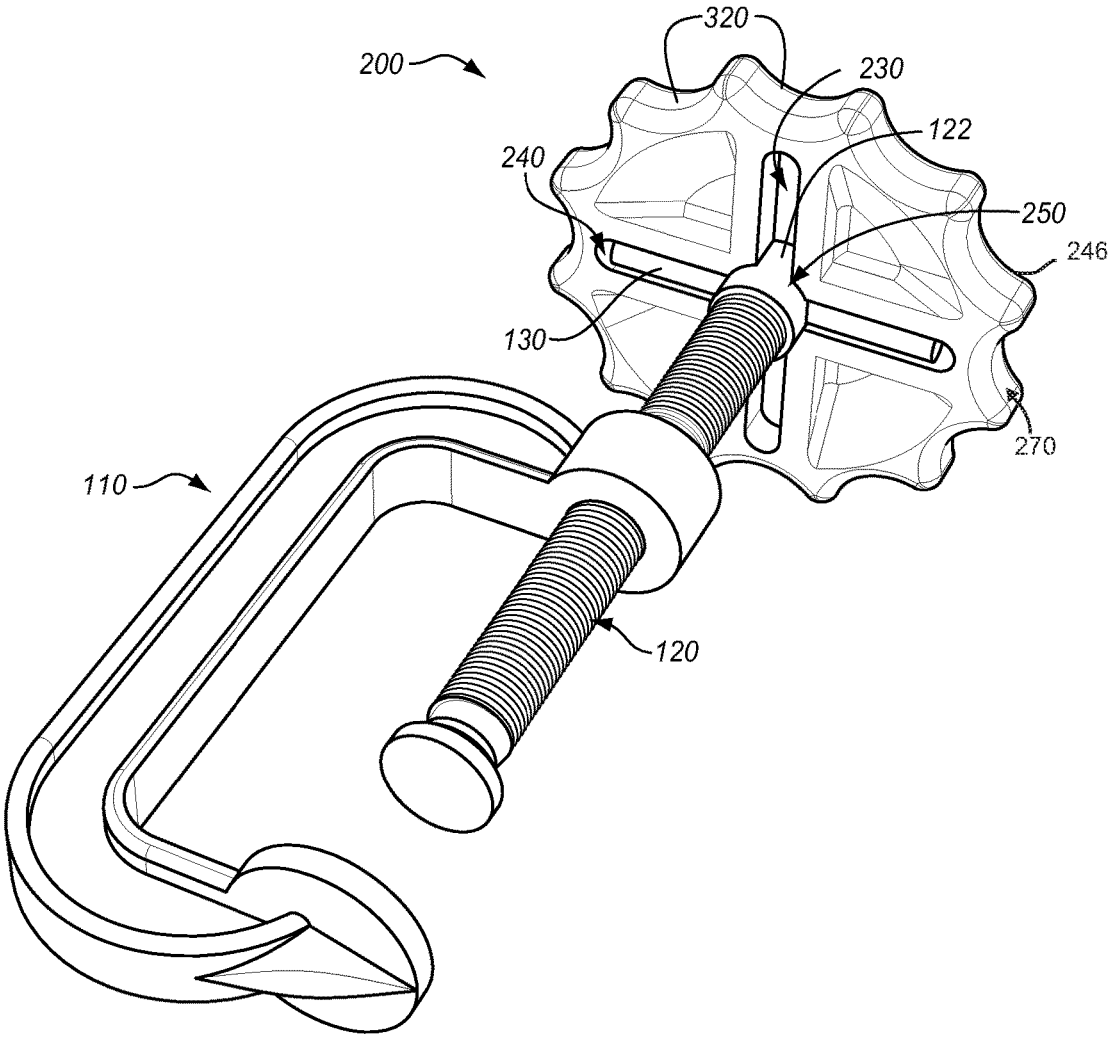
FIG. 3B is a perspective view of another embodiment of a handle attachment engaged with a C-clamp in an exemplary embodiment.

FIG. 3B is a perspective view of another embodiment of the handle attachment 200 engaged with the C-clamp 110 in an exemplary embodiment. FIG. 3B shows an example of alternative features to the handle attachment 200 described above. For instance, the body 246 of the handle attachment 200 may be circular or disc shaped with the perimeter 270 having a plurality of curved indentations 320 that provide gripping surfaces on sides of the handle attachment 200 to ergonomically rotate the T-bar 130. Thus, the handle attachment 200 may be formed with a number of gripping surfaces (e.g., handle members 301-304, curved indentations, etc.) independent from a number and/or shape of the channels 230/240. FIG. 3B also shows that the channels 230/240 may be closed at the perimeter 270. For instance, the channels 230/240 may be formed with a length that accommodates a long version of the T-bar 130 and/or a version of the T-bar which does not include the rounded ends 132. Alternatively, the perimeter 270 and/or channels 230/240 may be formed with the open ends 232-234/242-244 to accommodate a range of lengths of the T-bar 130 and/or to accommodate features which increase frictional restraint of the T-bar 130 as described above. Thus, it will be appreciated that the handle attachment 200 may be formed in numerous combinations of body structure styles, shapes, sizes, and features.

Figure 4:
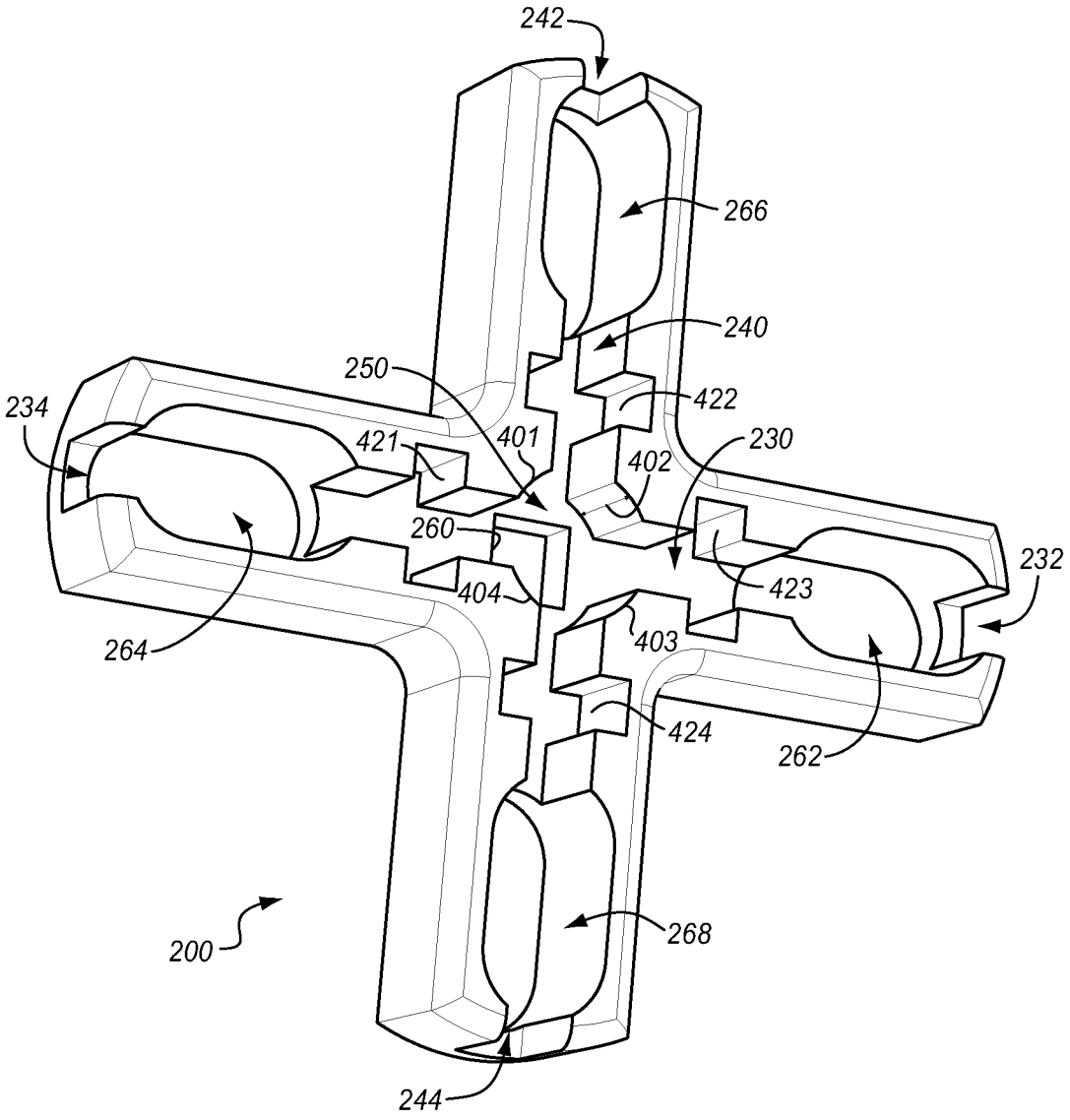
FIG. 4 is a perspective view of a handle attachment with clip spaces in an exemplary embodiment.

To further enhance the ability to engage with numerous shapes and sizes of the T-bar 130, the handle attachment 200 may be modified to incorporate clip spaces. FIG. 4 is a perspective view of the handle attachment 200 with clip spaces 421-424 in an exemplary embodiment. The clip spaces 421-424 are additional grooves, or notches, in the first side 210 of the handle attachment 200 that cross a long axis of the channels 230/240. Each of the channels 230/240 may incorporate one or multiple clip spaces 421-424. In embodiments in which a plurality of the clip spaces 421-424 are provided for one of the channels 230/240, the clip spaces 421-424 may be located on opposite sides of the center 250, and may be equidistant from the center 250 for rotational symmetry. FIG. 4 also shows that the center 250 may be defined by curved inner walls 401-404 to accommodate a circular shape of the collar 122 at the top end of the screw 120.

As shown in the exemplary embodiment of FIG. 4, the first channel 230 may include a first pair of clip spaces 421/423 on either side of the center 250, and the second channel 240 may include a second pair of clip spaces 422/424 on either side of the center 250. Each of the clip spaces 421-424 may be centered across a longitudinal axis of a channel 230/240 (and/or with respect to one of the handle members 301-304) at a location between the center 250 and one of the grip holes 262-268. For instance, the clip space 421 crosses the first channel 230 at a location between the center 250 and the grip hole 264, the clip space 422 crosses the second channel 240 at a location between the center 250 and the grip hole 266, and so on. The clip spaces 421-424 may be sized with a similar or equal depth as the channels 230/240 and may also be sized to receive clips as described in greater detail below.

Figure 5A:
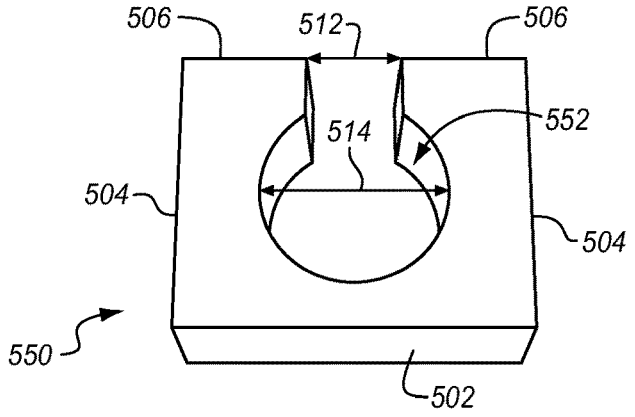
FIG. 5A is a perspective view of a clip in an exemplary embodiment.

FIG. 5A is a perspective view of a clip 550 in an exemplary embodiment. The clip 550 is a structure with a bottom surface 502, side surfaces 504, and a top surface 506, and the dimensions thereof generally correspond with at least one of the clip spaces 421-424 in the handle attachment 200 as described below. The clip 550 is configured to receive and retain a cylindrical member such as the T-bar 130. The clip 550 includes a slit 512 in the top surface 506 and further includes a passage 552 through the body of the clip 550 underneath the slit 512. The passage 552 and the slit 512 collectively define a continuous opening in the clip 550 with a gap in the top surface 506 having a width indicated by the arrows of the slit 512 and the passage 552 being shaped (e.g., circular, U-shaped, etc.) with a maximum dimension 514 larger than the width of the slit 512 in a parallel direction, as indicated by the arrows in FIG. 5A. That is, at least a portion of the passage 552 is wider than the slit 512 along a parallel direction so that the clip 550 is able to secure different circumference sizes of the T-bar 130 as described below.

Figure 5B:
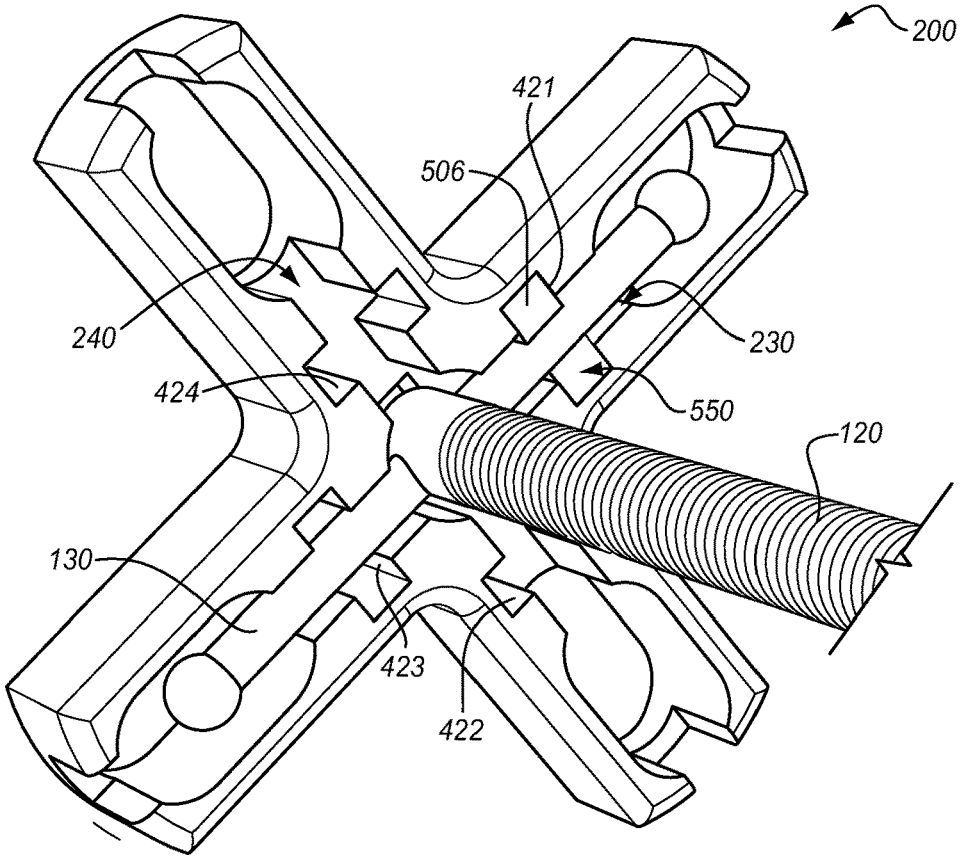
FIG. 5B is a perspective view of a clip inserted into a handle attachment and engaged with a C-clamp in an exemplary embodiment.

FIG. 5B is a perspective view of a clip 550 inserted into a handle attachment 200 and engaged with a C-clamp 110 in an exemplary embodiment. The clip 550 may be inserted into one of the clip spaces 421-424 in the handle attachment 200. In this example, the clip 550 is shown inserted into the clip space 421 of the first channel 230, and the T-bar 130 has pressed through the slit 512 to occupy the passage 552 in the clip 550 and the first channel 230. With the clip 550 situated within the clip space 421, the passage 552 of the clip 550 aligns with the longitudinal axis of the first channel 230. When there are differences between the passage 552 and the first channel 230 in size, shape, and/or material, the differences modify the engagement characteristics of the first channel 230. The clip 550 may vary in size, shape, and/or style of the passage 552 (or surface defining the passage 552) and may be incorporated with the clip spaces 421-424 in various combinations to adapt the channels 230/240 of the handle attachment 200 to a wide range of different types of the T-bar 130.

Suppose, for example, that the clip 550 is sized with the maximum dimension 514 being shorter than a width between the inner walls of the first channel 230. When inserted into the clip space 421, the clip 550 effectively narrows the first channel 230 so that the handle attachment 200 is able to securely clasp versions of the T-bar 130 that have smaller bar circumferences. That is, smaller versions of the T-bar 130 may be held in a consistent parallel position within the first channel 230 during rotation with the handle attachment 200. With the T-bar 130 contained with minimized leeway within the first channel 230, there is improved opportunity for applying high rotational force to the handle attachment 200 without slip and the additional options for applying high rotation force provided by the handle attachment 200 may be used. If it is desirable for the handle attachment 200 to later engage a larger diameter version of the T-bar 130, the clip 550 may be removed from the clip space 421 so that a larger version of the T-bar 130 may be engaged with the first channel 230 in the absence of the clip 550. Therefore, the handle attachment 200 may adapt to a wide range of different circumferences of the T-bar 130.

As another example, the clip 550 may space the T-bar 130 a distance from the floor bed of the channels 230/240 so that the handle attachment 200 may engage a version of the C-clamp 110 in which the collar 122 is long relative to the T-bar 130, thereby enabling the center 250 is able to accommodate the collar 122 while the channels 230/240 engage the T-bar 130. Alternatively or additionally, the clip 550 may be formed with the passage 552 having a different shape and/or material than the first channel 230 to adapt the channels 230/240 to different bar shapes and/or for increased frictional restraint for particular types of the T-bar 130.

As shown in FIG. 5B, the clip 550 and the clip space 421 may be sized such that, upon insertion, the bottom surface 502 of the clip 550 is flush with the floor bed of the first channel 230, the side surfaces 504 are flush with the inner walls of the clip space 421, and/or the top surface 506 is flush with the top surface of the first side 210. The dimensions of the clip space 421 may be slightly larger than dimensions of the clip 550 such that the clip 550 is removable from the clip space 421 but does not easily fall out of the clip space 421 under gravitational forces. The clip 550 may be molded (e.g., via injection molding, investment casting, 3-D printing, etc.) to form a unitary structure that is separate and removable from the handle attachment 200. Alternatively, the clip 550 may be molded with and/or fixed with the handle attachment 200. The clip 550 may include the same material as the handle attachment 200. Alternatively, the clip 550, or at least the surface defining the passage 552 of the clip 550, may be a different material than the handle attachment 200. The clip 550 may include additional or alternative features as described in greater detail below.

Figure 6A:
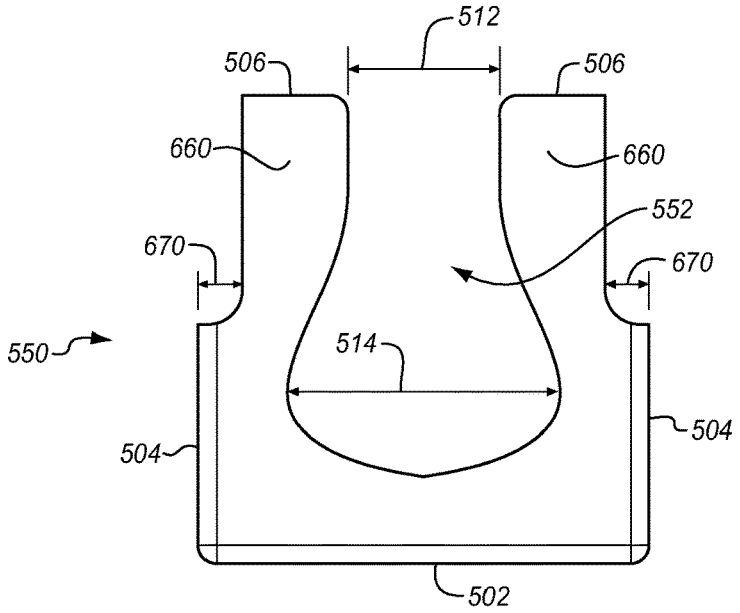
FIG. 6A is a front view of a clip in another exemplary embodiment.
Figure 6B:
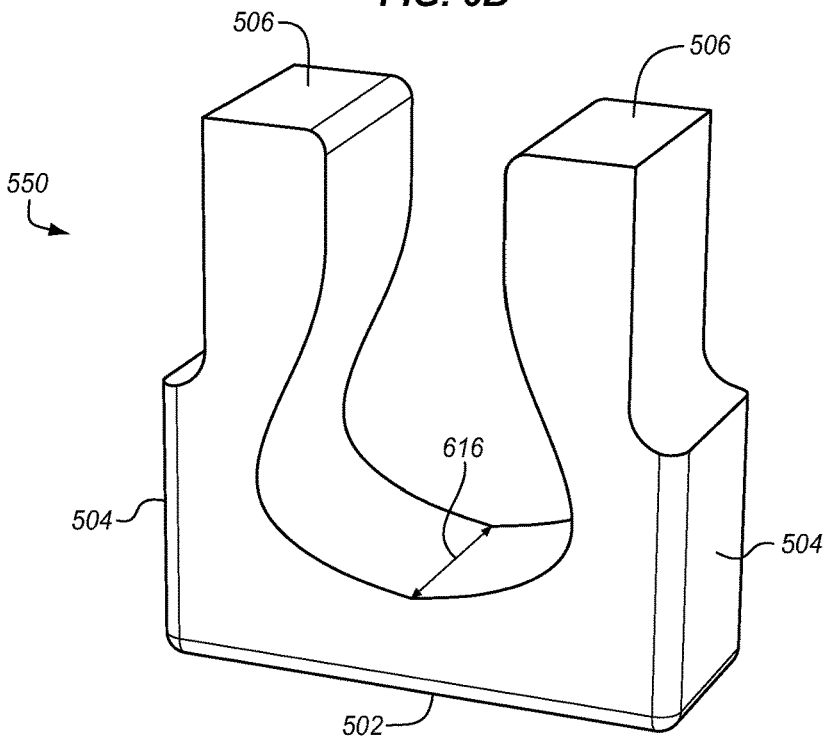
FIG. 6B is a perspective view of a clip in another exemplary embodiment.
Figure 6C:
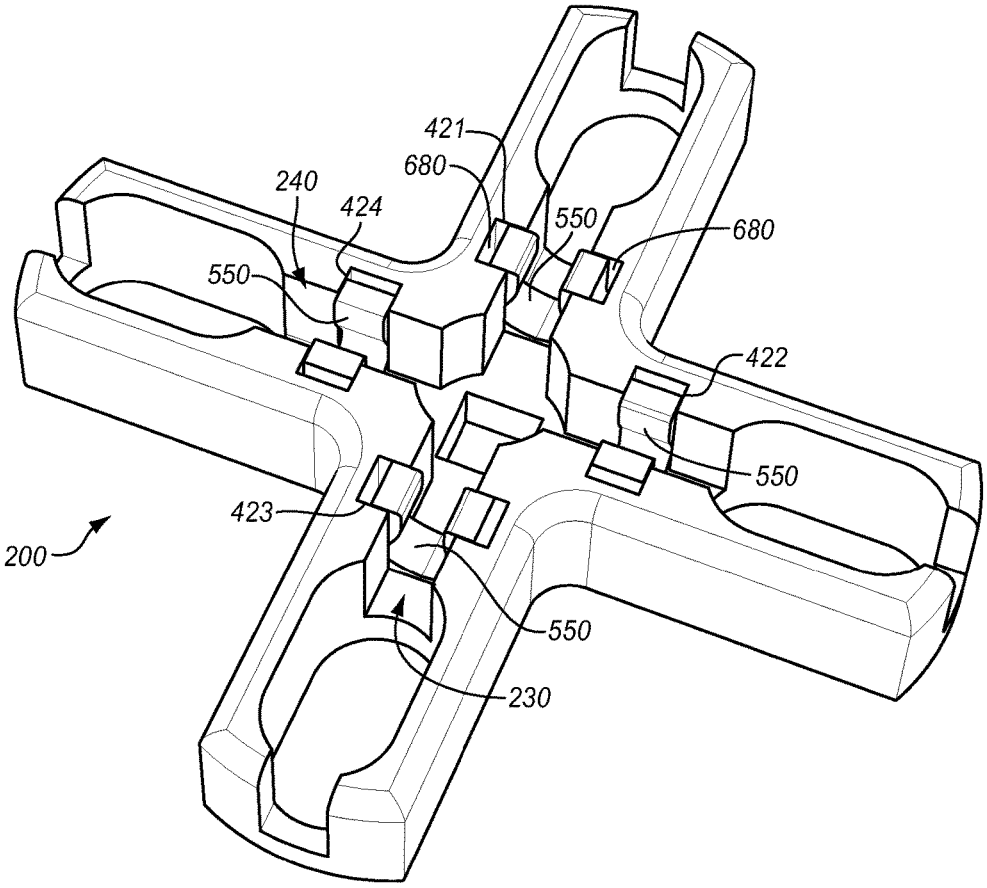
FIG. 6C is a perspective view of multiple clips inserted into a handle attachment in an exemplary embodiment.

FIG. 6A is a front view of the clip 550 in another exemplary embodiment. In this example, the clip 550 includes indentations 670 in the side surfaces 504 to form flexible tabs 660 or top portions of the clip 550 that enable receiving a range of sizes or diameters of the T-bar 130. FIG. 6B is a perspective view of the clip 550 of the clip 550 shown in FIG. 6A. FIG. 6B shows the clip 550 includes a passage length 616 in the direction of the longitudinal axis of the channels 230/240. FIG. 6C is a perspective view of multiple clips 550 inserted into the handle attachment 200 in an exemplary embodiment. As shown here, multiple clips 550 may be situated with each of the clip spaces 421-424. The bottom surface 502 of each clip 550 lies across a corresponding channel 230/240 on a floor plane of that channel 230/240 and the passage 552 of each clip 550 aligns with the longitudinal axis of that channel 230/240, similar to that already described.

As shown in FIG. 6C, the indentations 670 in the side surfaces 504 of each clip 550 creates gaps 680 between the flexible tabs 660 and the walls of the clip spaces 421-424. The flexible tabs 660 (see FIG. 6A) of the clip 550 may therefore temporarily expand away from one another to widen the gap in the slit 512 as the T-bar 130 with a larger diameter or width than the slit 512 passes through. Expansion or deformation of the flexible tabs 660 may also widen the maximum dimension 514 of the passage 552. The flexible tabs 660 may then return, or at least partially return, to their originally formed position when the T-bar 130 engages the passage 552 (thereby increasing conferential contact of the passage 552 around the T-bar 130 for secure rotation) or is removed from the clip 550. The flexible tabs 660 therefore advantageously enable further adaptability of the clip 550 and the channels 230/240 to differences in diameter or width of the T-bar 130.

Figure 7A:
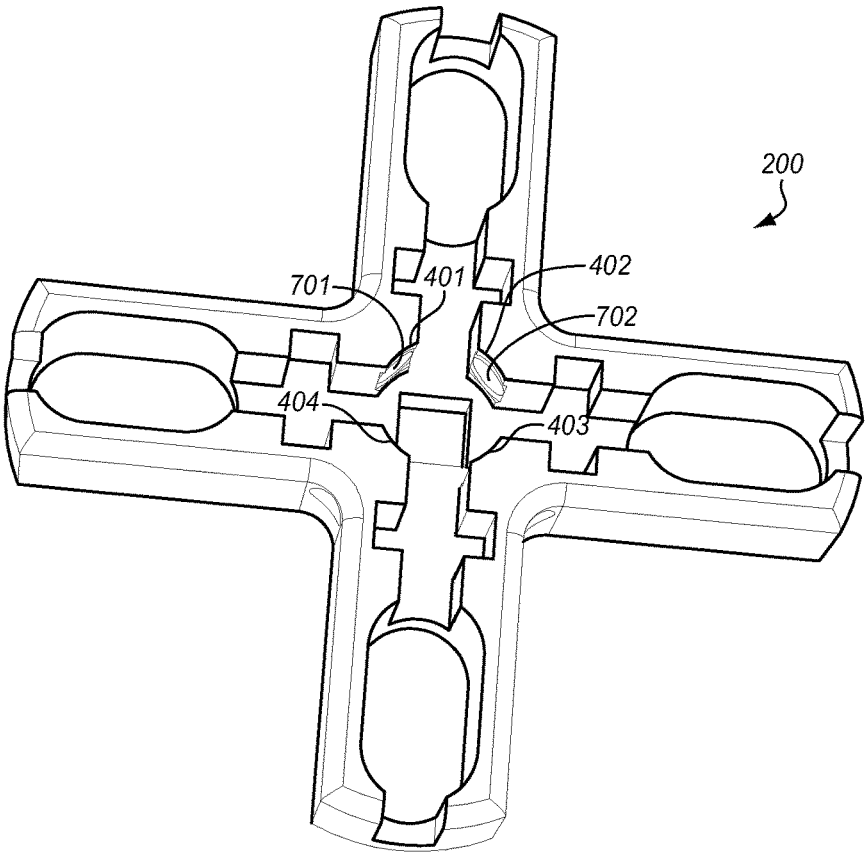
FIG. 7A is a perspective view of a handle attachment with a center grip feature in an exemplary embodiment.

FIG. 7A is a perspective view of the handle attachment 200 with a center grip feature in an exemplary embodiment. As shown in FIG. 7A, the handle attachment 200 may include chambers 701-702 in the curved inner walls 401-404 surrounding the center 250. The chambers 701-702 define hollow space into the curved inner walls 401-404 which may extend through to the perimeter 270 of the handle attachment 200. The chambers 701-702 are generally uniformly shaped (e.g., cylindrical) with a longitudinal axis parallel with and between the first side 210 and the second side 220 of the handle attachment 200, and terminating at an opening in the curved inner walls 401-404 that faces the corners of the intersection of the channels 230/240.

Figure 7B:
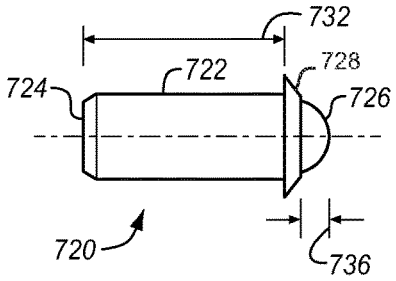
FIG. 7B is a side view of a spring loaded bullet pin in an exemplary embodiment.

FIG. 7B is a side view of a spring loaded bullet pin 720 in an exemplary embodiment. The spring loaded bullet pin 720 includes a cylindrical body 722 with a base end 724, a shoulder portion 728 distal from the base end 724, and a compressible head 726 that protrudes from the shoulder portion 728. The compressible head 726 may include a rounded surface and may attach to a spring member within the cylindrical body 722. In an uncompressed state, compressible head 726 extends from the shoulder portion 728 for a compression length 736. In a compressed state, compressible head 726 retracts into the cylindrical body 722. The cylindrical body 722 may have a body length 732 corresponding with a longitudinal axis of one of the chambers 701-702 as described in further detail below.

Figure 7C:
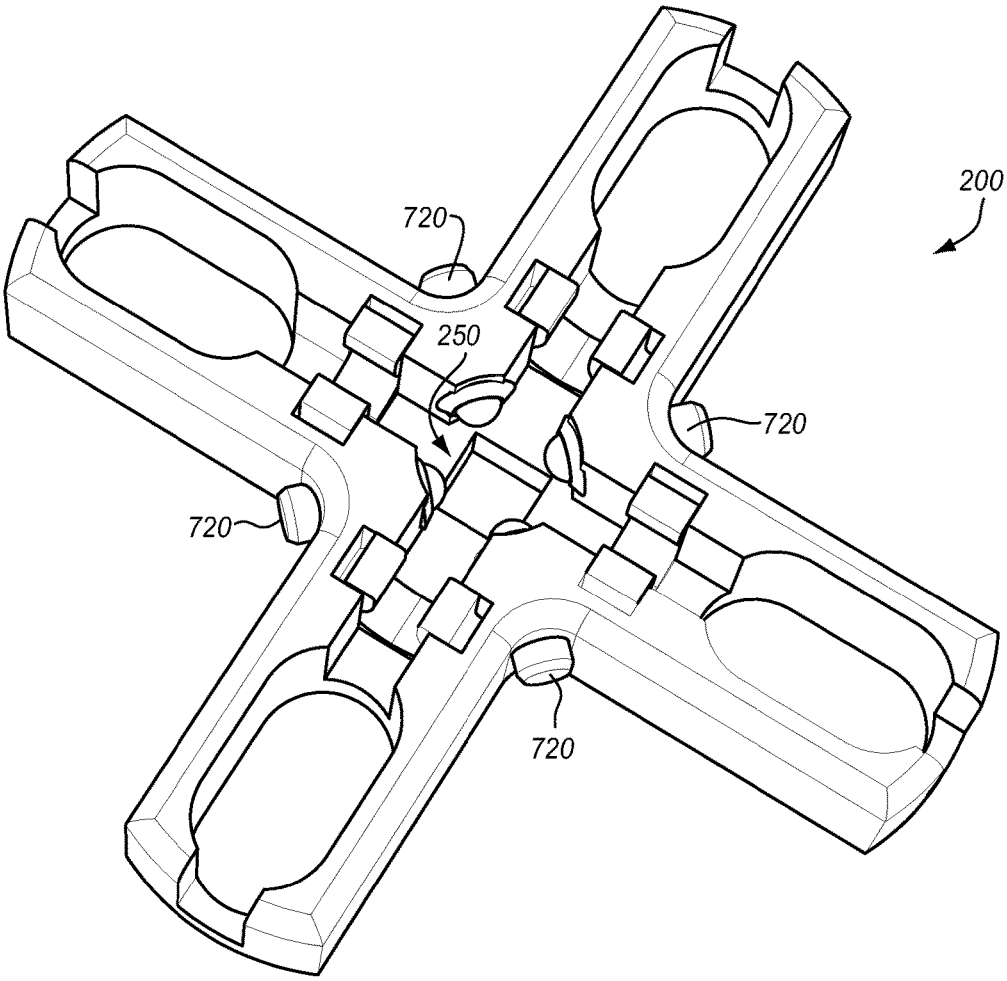
FIG. 7C is a perspective view of a handle attachment with a center grip feature holding spring loaded bullet pins in an exemplary embodiment.

FIG. 7C is a perspective view of the handle attachment 200 with a center grip feature holding spring loaded bullet pins 720 in an exemplary embodiment. As shown in FIG. 7C, each chamber 701-702 may hold a spring loaded bullet pin 720. The bullet pin 720 and the chamber 701-702 are sized such that the cylindrical body 722 fits through the chamber 702 until the shoulder portion 728 meets the surface of the curved inner walls 401-402. The spring loaded bullet pins 720 are thus secured in the chambers 701-702 via the shoulder portions 728. The base end 724 may protrude from the perimeter 270 in this installed position.

The compressible heads 726 face and protrude into the center 250 from the curved inner walls 401-404 to effectively narrow the space within the center 250 of the handle attachment 200. When the collar 122 on the screw 120 of the C-clamp 110 presses into the center 250 of the handle attachment 200, surface contact causes the compressible heads 726 to retract into their respective cylindrical bodies 722 and/or chambers 701-702 to expand the radius of the center 250 in a range defined by the compression length 736. The spring loaded bullet pins 720 may thus advantageously provide a centering force to stabilize a range of different sizes for the collar 122. Additionally, the compressible heads 726 may protrude/press into sides of the T-bar 130 where the T-bar 130 intersects with the screw 120 or collar 122 to further secure the T-bar 130 under high rotational forces applied to the handle attachment 200.

Figure 7D:
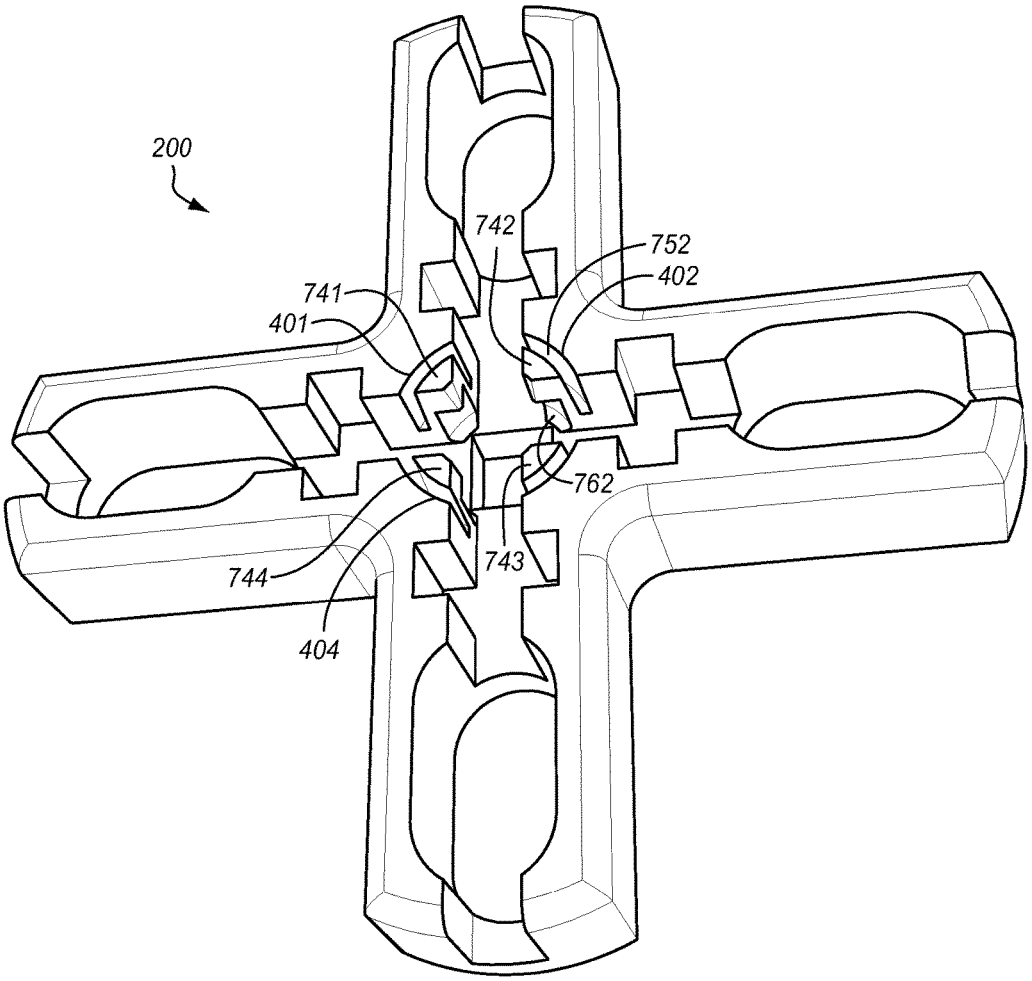
FIG. 7D is a perspective view of a handle attachment with a center grip feature in another exemplary embodiment.

FIG. 7D is a perspective view of the handle attachment 200 with a center grip feature in another exemplary embodiment. In this example, the curved inner walls 401-404 are modified to include flexible elements 741-744 integrally formed with the handle attachment 200. The flexible elements 741-744 face the center 250 and expand outwardly from the center 250 into the curved inner walls 401-404 to accommodate stabilization of the collar 122 similar to that already described above. To that end, flexible elements 741-744 may each include a portion of a circular groove 752 that provides a range of flexible movement between the flexible elements 741-744 and the curved inner walls 401-404. The flexible elements 741-744 may also include an indenture 762 opposite of the circular groove 752 to create a sufficiently thin structure near a base (e.g., where the flexible elements 741-744 attach to the floor and/or the curved inner walls 401-404 along the center 250 or the channels 230/240) such that the flexible elements 741-744 may bend. The circular groove 752 may have a depth shorter than the depth in the center 250 or the channels 230/240 for sufficiently attaching the flexible elements 741-744 to the curved inner walls 401-404. Thus, the flexible elements 741-744 may be spaced a distance from the curved inner walls 401-404 in an area above the attached base to allow the flexible elements 741-744 to retract outwardly from one another via contact with the collar 122 of the screw 120.

Figure 8A:
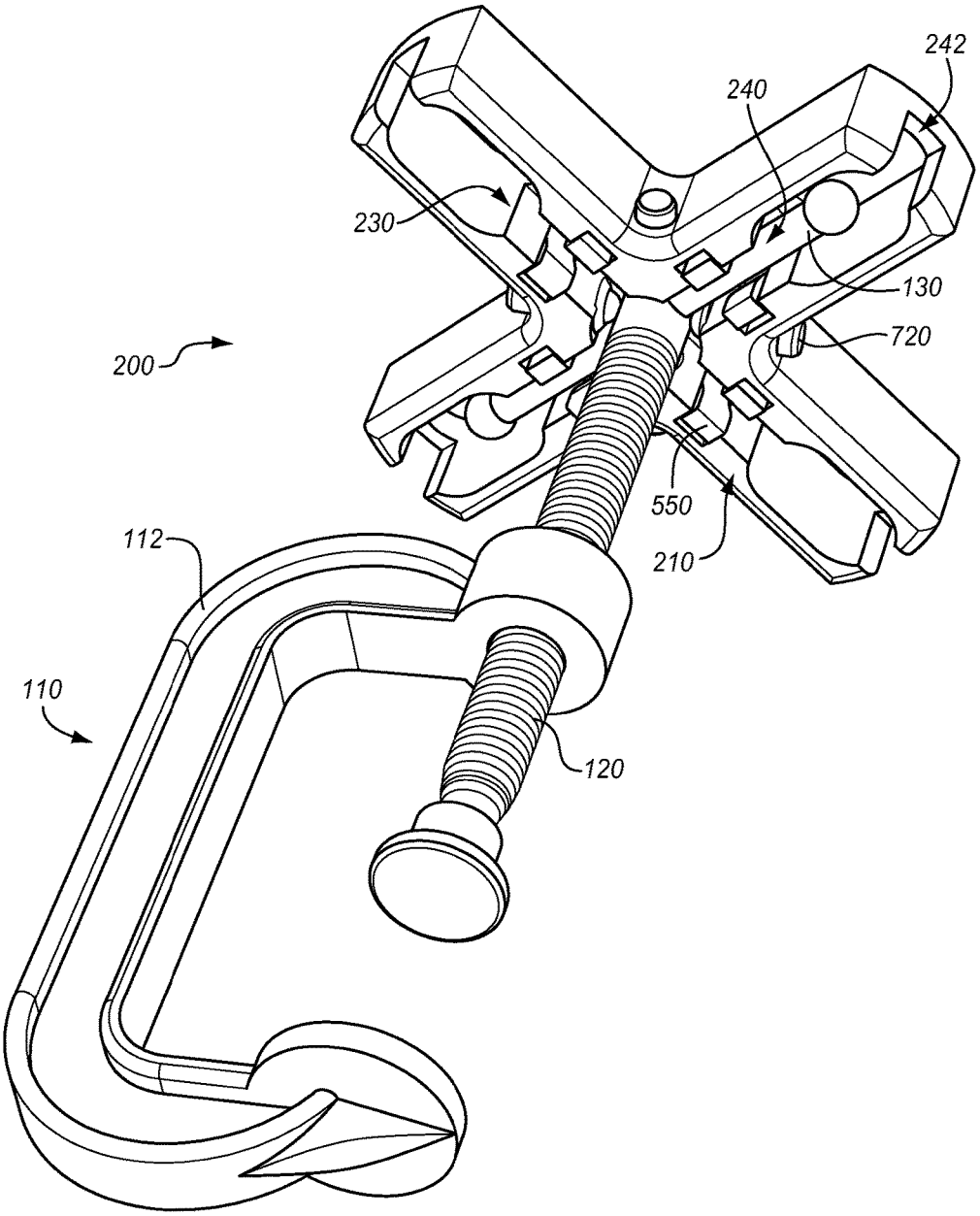
FIG. 8A is a perspective view of a handle attachment engaged with a C-clamp in an exemplary embodiment.

FIG. 8A is a perspective view of the handle attachment 200 engaged with the C-clamp 110 in an exemplary embodiment. As shown by this example, the handle attachment 200 may be modified to include a pair of the clips 550 in each of the channels 230/240. In some embodiments, the pair of clips 550 installed with the first channel 230 may be of the same size or type as one another, and the pair of clips 550 installed with the second channel 240 may be of the same size or type as one another but a different size or type as those in the first channel 230. The handle attachment 200 may therefore be configured with multiple channels 230/240 having different engagement ability from one another so that the handle attachment 200 is adapted to properly secure at least two different types of the T-bar 130 or two different ranges of types of the T-bar 130.

Figure 8B:
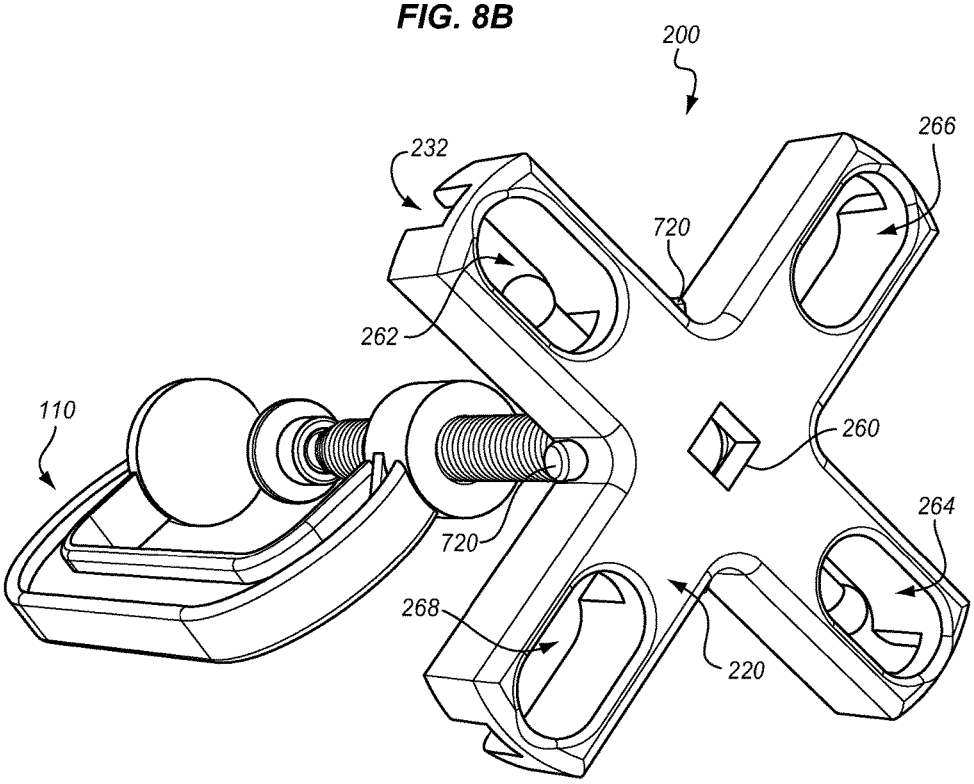
FIG. 8B is another perspective view of a handle attachment with a C-clamp in an exemplary embodiment.

FIG. 8B is another perspective view of the handle attachment 200 with the C-clamp 110 in an exemplary embodiment. FIG. 8B shows a view of the second side 220 of the handle attachment 200 while the first side 210 is engaged with the T-bar 130. As shown in this example, the drive 260 may be sized smaller than the center 250 such that when the collar 122 is positioned in the center 250 it is visible through the drive 260 but does not interfere with the space of the drive 260. The example also shows that either end of the T-bar 130 may be visible through the grip holes 262-264 of the channel 230/240 desired for engaging with the T-bar 130 to facilitate alignment and attachment of the channel 230/240 to the T-bar 130. Moreover, the grip holes 266-268 of the channel 230/240 not engaged with the T-bar 130 provide an area and surface for applying rotational force to the handle attachment 200 other than traditional hand grip rotation. For instance, a cylindrical rod may be inserted through the grip holes 266-268 and an increased rotational force may be applied to the handle attachment 200 due to the leveraging force applied by the rod to the handle attachment 200.

Figure 8C:
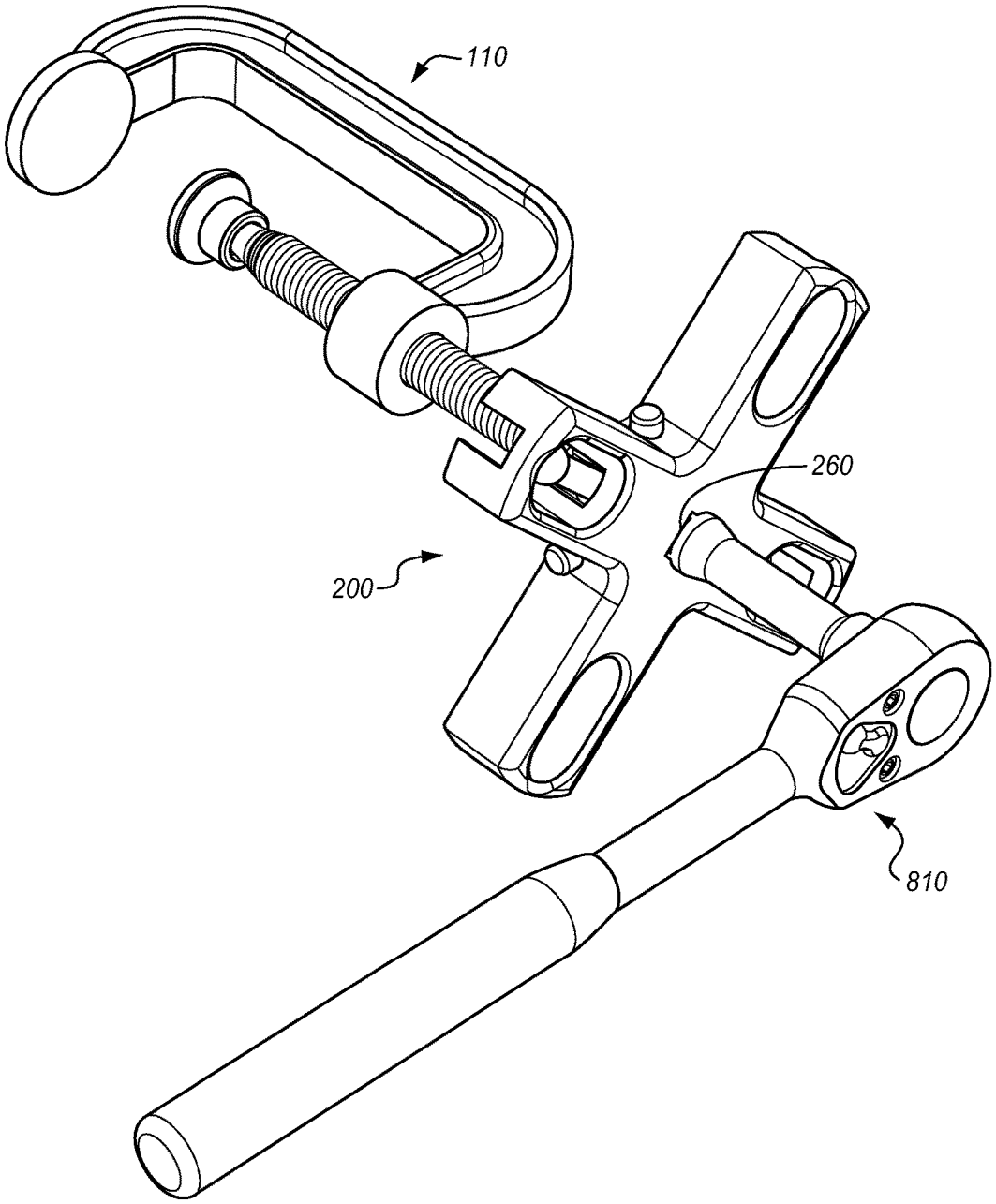
FIG. 8C is perspective view of a handle attachment engaged with a rotational tool in an exemplary embodiment.
Figure 8D:
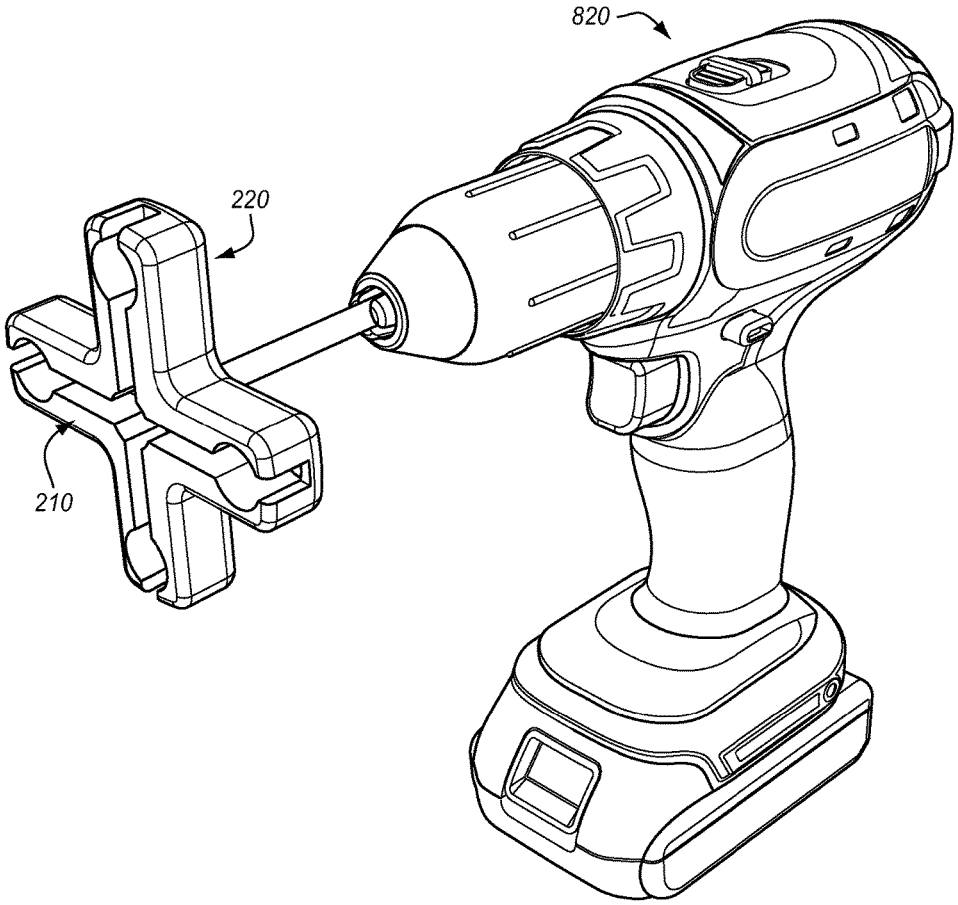
FIG. 8D is perspective view of a handle attachment engaged with a power tool in an exemplary embodiment.

FIG. 8C is perspective view of the handle attachment 200 engaged with a rotational tool 810 in an exemplary embodiment. FIG. 8D is perspective view of the handle attachment 200 engaged with a power tool 820 in an exemplary embodiment. As shown in these examples, the rotational tool 810 or the power tool 820 may engage the drive 260 from the second side 220 of the handle attachment 200. The drive 260 is a non-circular hollow space which advantageously accommodates increased rotational forces due to the leverage of the rotational tool 810 or the power tool 820 which is imparted through the structural body of the handle attachment 200 and to the T-bar 130 and the screw 120.

It will be appreciated that the drawings and descriptions of the handle attachment 200 are exemplary for discussion purposes, and that additional or alternative components, component combinations/configurations, and relative sizes/positions/shapes of components are possible. Although specific embodiments were described herein, the scope is not limited to those specific embodiments. Rather, the scope is defined by the following claims and any equivalents thereof.

What is claimed is:

1. An apparatus comprising:

a handle attachment configured to attach to a C-clamp with a screw and a T-bar perpendicular to the screw, the handle attachment comprising:

a rigid body having a first side configured to engage the C-clamp, and a second side opposite to the first side configured to engage a rotation tool;

a first channel extending across the first side that is configured to receive the T-bar;

a second channel extending across the first side perpendicularly with the first channel that is configured to receive the T-bar;

a center space in the first side at an intersection of the first channel and the second channel that is configured to receive a top end of the screw;

first clip spaces in the first channel on both sides of the center space;

second clip spaces in the second channel on both sides of the center space;

first clips situated in the first clip spaces; and second clips situated in the second clip spaces;

wherein the first clips and the second clips each include an opening to secure the T-bar within the first channel and the second channel, respectively.

2. The apparatus of claim 1 wherein:

the opening in each of the first clips and the second clips is sized smaller than the first channel and the second channel.

3. The apparatus of claim 1 wherein:

each of the first clips and the second clips are removable from the first clip spaces and the second clip spaces, respectively.

4. The apparatus of claim 1 wherein:

each of the first clips and the second clips include a flexible top portion above the opening that is configured to receive a range of sizes of the T-bar.

5. The apparatus of claim 1 wherein:

the handle attachment further comprising:

curved inner walls surrounding the center space;

chambers in the curved inner walls that face the center space; and spring loaded members situated within the chambers, each spring loaded member having a compressible head which protrudes from a curved inner wall into the center space, the compressible head configured to retract from the center space into the curved inner wall from contact with the top end of the screw.

6. The apparatus of claim 1 wherein:

the opening in each of the first clips and the second clips is a different shape than the first channel and the second channel.

7. The apparatus of claim 1 wherein:

the opening in each of the first clips and the second clips is outlined with a different material than a material of the first channel and the second channel.

8. The apparatus of claim 1 wherein:

the first clips and the second clips are integrally formed with the rigid body of the handle attachment.

9. The apparatus of claim 1 wherein:

the rigid body of the handle attachment is a circular disc with a plurality of indentations around a perimeter of the circular disc.

10. The apparatus of claim 1 wherein:

the rigid body of the handle attachment is defined by a perimeter that is cross-shaped to outline the first channel and the second channel; and the perimeter is open at ends of the first channel and the second channel to accommodate a range of lengths of the T-bar.

11. The apparatus of claim 10 wherein:

the second side of the rigid body includes:

a drive located at a center rotational axis of the rigid body opposite to the center space of the first side, the drive configured to receive the rotational tool; and grip holes located a distance from the center proximate to the open ends of the first channel and the second channel.

12. An apparatus comprising:

a handle attachment configured to attach to a clamp with a screw and a bar attached through a screw collar near a top end of the screw, the handle attachment comprising:

a body having a first side configured to engage the screw collar and the bar of the clamp, and a second side opposite to the first side;

a plurality of channels formed in the first side sized to receive the bar of the clamp, wherein the channels cross one another to form an intersection at a center of the first side;

a plurality of walls spaced around the intersection of the channels to define a center space sized to receive the screw collar of the clamp, each wall located at a corner of the intersection and facing the center; and flexible members extending from the walls toward the center, the flexible members configured to retract away from the center toward the walls from contact with the screw collar of the clamp.

13. The apparatus of claim 12 wherein:

the flexible members are integrally formed with the walls to form an attached base and are spaced a distance from the walls in an area above the attached base.

14. The apparatus of claim 12 wherein:

the flexible members include spring loaded bullet pins in the walls, wherein each spring loaded bullet pin includes a compressible head extending from the wall into the corner of the intersection.

15. The apparatus of claim 12 wherein:

the handle attachment further comprising:

clip spaces in the channels; and removable clips inserted in the clip spaces, the removable clips comprising a structure with a passage that aligns with a longitudinal axis of one of the channels, the passage being a different size than the one of the channels to secure the bar of the clamp.

16. An apparatus comprising:

a handle attachment configured to attach to a clamp with a screw and a bar attached through a screw collar near a top end of the screw, the handle attachment comprising:

a body with a cross-shaped perimeter to form a plurality of handle members, a first side with a first top surface, and a second side opposite to the first side with a second top surface, wherein the cross-shaped perimeter defines a thickness of the body and connects the first top surface with the second top surface, and wherein the first top surface and the second top surface are substantially flat and parallel with one another;

channels formed along the first side to receive the bar, the channels centered inside the cross-shaped perimeter and having a depth into the first top surface that is smaller than the thickness of the cross-shaped perimeter, the channels intersecting one another near a center of the first side and extending through ends of the handle members to form openings in the cross-shaped perimeter;

a circular space at the center of the first side to receive the screw collar, the circular space having the depth into the first side;

clip spaces crossing longitudinal axes of the channels sized to receive removable clips and having the depth into the first side, wherein the removable clips having passages that align with the longitudinal axes of the channels, and wherein the passages are sized smaller than the channels to secure the bar;

curved inner walls surrounding the circular space;

chambers in the curved inner walls that face the center; and spring loaded members situated within the chambers, each spring loaded member having a compressible head which protrudes from the curved inner wall into the circular space, the compressible head configured to retract from the circular space into the curved inner wall from contact with the screw collar.

17. The apparatus of claim 16 wherein:

the second side of the body includes:

a drive that forms a non-circular hollow space extending into the second top surface and through the body of the handle attachment, the drive being aligned with the circular space of the first side.

18. The apparatus of claim 17 wherein:

the second side of the body further includes:

a grip hole in each of the handle members, the grip holes extending into the second top surface and through the body of the handle attachment.

19. The apparatus of claim 18 wherein:

the grip holes are equidistant from the drive and proximate to the cross-shaped perimeter on the handle members.

20. The apparatus of claim 16 wherein:

the removable clips include flexible top portions to secure a range of diameters of the bar.

* * * * *